US005887761A

United States Patent [19]

Foster et al.

[11] Patent Number: 5,887,761

[45] Date of Patent: Mar. 30, 1999

[54] DUAL FLUID DISPENSER

[75] Inventors: Donald D. Foster; Martin S. Laffey, both of St. Charles, Mo.

[73] Assignee: Continental Sprayers International, Inc., St. Peters, Mo.

[21] Appl. No.: 786,261

[22] Filed: Jan. 22, 1997

[51] Int. Cl.[6] ..... B05B 9/043

[52] U.S. Cl. ..... 239/304; 239/333; 222/383.1

[58] Field of Search ..... 239/333, 304, 239/398; 222/135, 137, 144.5, 255, 383.1

[56] References Cited

U.S. PATENT DOCUMENTS

| | | | |
|---|---|---|---|
| D. 336,846 | 6/1993 | Proctor | D9/300 |
| 3,760,986 | 9/1973 | Castner et al. | 222/137 |
| 3,966,089 | 6/1976 | Klingaman | 222/88 |
| 4,355,739 | 10/1982 | Vierkötter | 222/134 |
| 4,765,510 | 8/1988 | Rende | 222/79 |
| 4,826,048 | 5/1989 | Skorka et al. | 222/135 X |
| 4,902,281 | 2/1990 | Avoy | 239/304 X |
| 5,009,342 | 4/1991 | Lawrence et al. | 222/136 |
| 5,152,431 | 10/1992 | Gardner et al. | 222/136 |
| 5,152,461 | 10/1992 | Proctor | 239/304 |
| 5,169,029 | 12/1992 | Behar et al. | 222/1 |
| 5,332,157 | 7/1994 | Proctor | 239/304 |
| 5,339,990 | 8/1994 | Wilder | 222/135 |
| 5,398,846 | 3/1995 | Corba et al. | 222/1 |
| 5,402,916 | 4/1995 | Nottingham et al. | 222/383.1 X |
| 5,439,141 | 8/1995 | Clark et al. | 239/304 X |
| 5,472,119 | 12/1995 | Park et al. | 222/383.1 X |
| 5,535,950 | 7/1996 | Barriac et al. | 239/304 |
| 5,560,545 | 10/1996 | Grogan et al. | 239/304 |
| 5,562,250 | 10/1996 | O'Neill | 239/304 |

FOREIGN PATENT DOCUMENTS

| | | | |
|---|---|---|---|
| 598237 | 5/1994 | European Pat. Off. | 239/333 |
| 96/17800 | 6/1996 | WIPO . | |

*Primary Examiner*—Lesley D. Morris
*Attorney, Agent, or Firm*—Howell & Haferkamp, L.C.

[57] ABSTRACT

A dual fluid dispenser comprising a dispenser body and a nozzle. The dispenser body has first and second pump chambers, a first intake port adapted for fluid communication with a first liquid source, a second intake port adapted for fluid communication with a second with a first liquid source, a second intake port adapted for fluid communication with a second liquid source, first and second intake liquid flow paths for passage of fluid from the intake ports to the pump chambers, and first and second discharge liquid passageways. A third discharge liquid passageway is defined at least in part by the dispenser body. The third discharge liquid passageway includes a mixing chamber and a spinner chamber downstream of the mixing chamber. The first and second discharge liquid passageways are configured for passage of liquid from the first and second pump chambers to the mixing chamber. The nozzle includes a nozzle orifice in fluid communication with the spinner chamber. A fluid spinner member is in the spinner chamber. The pump chambers, and intake liquid flow paths are configured so that varying the volume of the pump chambers draws liquid from the intake liquid flow paths, forces the drawn liquids from the pump chambers to the mixing chambers where the liquids are mixed, and forces the mixed liquids through the spinner chamber and out the nozzle orifice.

23 Claims, 8 Drawing Sheets

DUAL FLUID DISPENSER

BACKGROUND OF THE INVENTION

This invention relates generally to dispensers, such as trigger sprayers, and more particularly to dispensers configured for simultaneously dispensing two fluid.

Trigger sprayers are those types of sprayers having pivoting triggers that are manually manipulated to dispense liquids from the sprayers. A conventional trigger sprayer is connected to a liquid container for dispensing the contents of the container as a spray, stream, or foam in response to manual reciprocation of the trigger. This type of trigger sprayer has been employed to dispense various different types of liquids from containers to which the trigger sprayers have been attached. However, such conventional trigger sprayer has drawbacks when employed with certain types of liquids. Certain liquids dispensed from conventional trigger sprayers are the product of two or more separate component liquids that remain stable while separated but have a limited shelf life when they are mixed together. Trigger sprayers attached to containers containing liquids of this type usually cannot remain in storage or on a store shelf for a prolonged period before the liquid product begins to lose effectiveness. To employ conventional trigger sprayers for dispensing liquids of this type and to increase the chance that the shelf life of the liquid product does not expire before the product is sold, the separate liquid components of the final liquid product must be mixed together to produce the final liquid product just prior to the liquid product being packaged in the containers and shipped to market where they are offered for sale. In addition, some liquid products are comprised of one or more component liquids that do not readily mix with each other, for example, water and oil. When liquid products of this type are packaged in containers with trigger sprayers, the separate liquid components that make up the final product tend to separate from each other while the product is stored in inventory or while the product sits on a store shelf awaiting sale. Subsequent operation of the trigger sprayer results in dispensing only that liquid component that had settled to the bottom of the container. In the oil and water example, only the water component of the liquid would be dispensed initially from the sprayer. Once all of the water is dispensed, then oil alone is dispensed.

Various multiple-compartment trigger sprayers have been designed in an effort to overcome the above-noted problems. These new designs include trigger sprayers that are attached to liquid containers that keep the component parts of a liquid product separate from each other until they are drawn from the containers by the trigger sprayers. Trigger sprayers of this type include sprayers that mix the separate component parts of a liquid product for the first time in the pump chambers of the sprayers prior to their being dispensed. However, even these newer designs of trigger sprayers have drawbacks. Once the trigger sprayer pump chamber is primed with the two components of the final liquid product, as the trigger sprayer sits between uses the shelf life of the liquid product in the pump chamber could expire. Also, the separate liquid components of the final product could separate from each other in the sprayer pump chamber. As a result, the next time the trigger sprayer is operated, the liquid first dispensed from the sprayer would be the left-over liquid remaining in the pump chamber. This liquid could have an expired shelf life or separated component liquids. In either situation, the quality of the liquid first dispensed from the sprayer would be less than that expected. Another disadvantage of the present trigger sprayers is that mixed liquids remaining in the trigger sprayers occasionally leaks back into the containers and contaminates the liquids.

A further disadvantage is the complexity of parts required to construct such trigger sprayers. This complexity increases the cost of manufacture and the difficulty of assembling the trigger sprayers.

SUMMARY OF THE INVENTION

Among the several objects of the present invention may be noted the provision of an improved dispenser which overcomes the disadvantages associated with conventional dispensers and trigger sprayers; the provision of an improved trigger sprayer for simultaneously dispensing two separately contained fluids; the provision of such a trigger sprayer having two pump chambers; the provision of such a trigger sprayer configured for preventing the two fluids from mixing in the pump chambers; the provision of such a trigger sprayer configured for resisting leakage of mixed fluid back into the pump chambers; the provision of such a trigger sprayer having parts configured for ease of manufacture and assemblage; and the provision of such a fluid pump which is of relatively simple construction.

In general, a trigger dispenser of the present invention is configured for drawing at least two separate liquids from first and second separate liquid sources and simultaneously dispensing the liquids from the dispenser. The dispenser comprises a dispenser body and first and second pump pistons. The dispenser body has first and second pump chambers, a first intake port adapted for fluid communication with the first liquid source, a second intake port adapted for fluid communication with the second liquid source, a first intake liquid flow path for passage of fluid from the first intake port to the first pump chamber, a second intake liquid flow path for passage of fluid from the second intake port to the second pump chamber, and first and second discharge liquid passageways for passage of liquid from the first and second pump chambers to a common location. The first and second pump pistons are respectively moveable in the first and second pump chambers. The pump pistons and pump chambers define first and second variable volume fluid receiving cavities. The pump pistons are reciprocally moveable in their respective pump chambers between extended positions in which the fluid receiving cavities have extended volumes and retracted positions in which the fluid receiving cavities have retracted volumes smaller than the extended volumes. The pump pistons and dispenser body are configured so that movement of the pump pistons from their retracted positions to their extended positions draws liquid from the intake liquid flow paths and movement of the pump pistons from their extended positions to their retracted positions discharges the drawn liquids from the pump chambers to the common location. First and second pusher members are respectively connected to the first and second pump pistons. A trigger is pivotally connected to the dispenser body for movement between first and second positions and is configured for engaging the first and second pusher members. The trigger and pusher members are configured so that movement of the trigger from its first position to its second position effectuates simultaneous movement of the pump pistons from their extended positions to their retracted positions, and movement of the trigger from its second position to its first position effectuates simultaneous movement of the pump pistons from their retracted positions to their extended positions. The first and second pusher members are configured to engage one another in a manner to limit relative movement therebetween as the trigger is moved between its first and second positions.

In another aspect of the present invention, a dispenser is configured for drawing at least two separate liquids from first and second separate liquid sources and simultaneously dispensing the liquids from the dispenser. The dispenser comprises a dispenser body having first and second pump chambers, a first intake port adapted for fluid communication with the first liquid source, a second intake port adapted for fluid communication with the second liquid source, a first intake liquid flow path for passage of fluid from the first intake port to the first pump chamber, a second intake liquid flow path for passage of fluid from the second intake port to the second pump chamber, and first and second discharge liquid passageways. A third discharge liquid passageway is defined at least in part by the dispenser body. The third discharge liquid passageway includes a mixing chamber and a spinner chamber downstream of the mixing chamber. The first discharge liquid passageway is configured for passage of liquid from the first pump chamber to the mixing chamber. The second discharge liquid passageway is configured for passage of liquid from the second pump chamber to the mixing chamber. A nozzle is connected to the dispenser housing. The nozzle includes a nozzle orifice in fluid communication with the spinner chamber. A fluid spinner member is in the spinner chamber. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
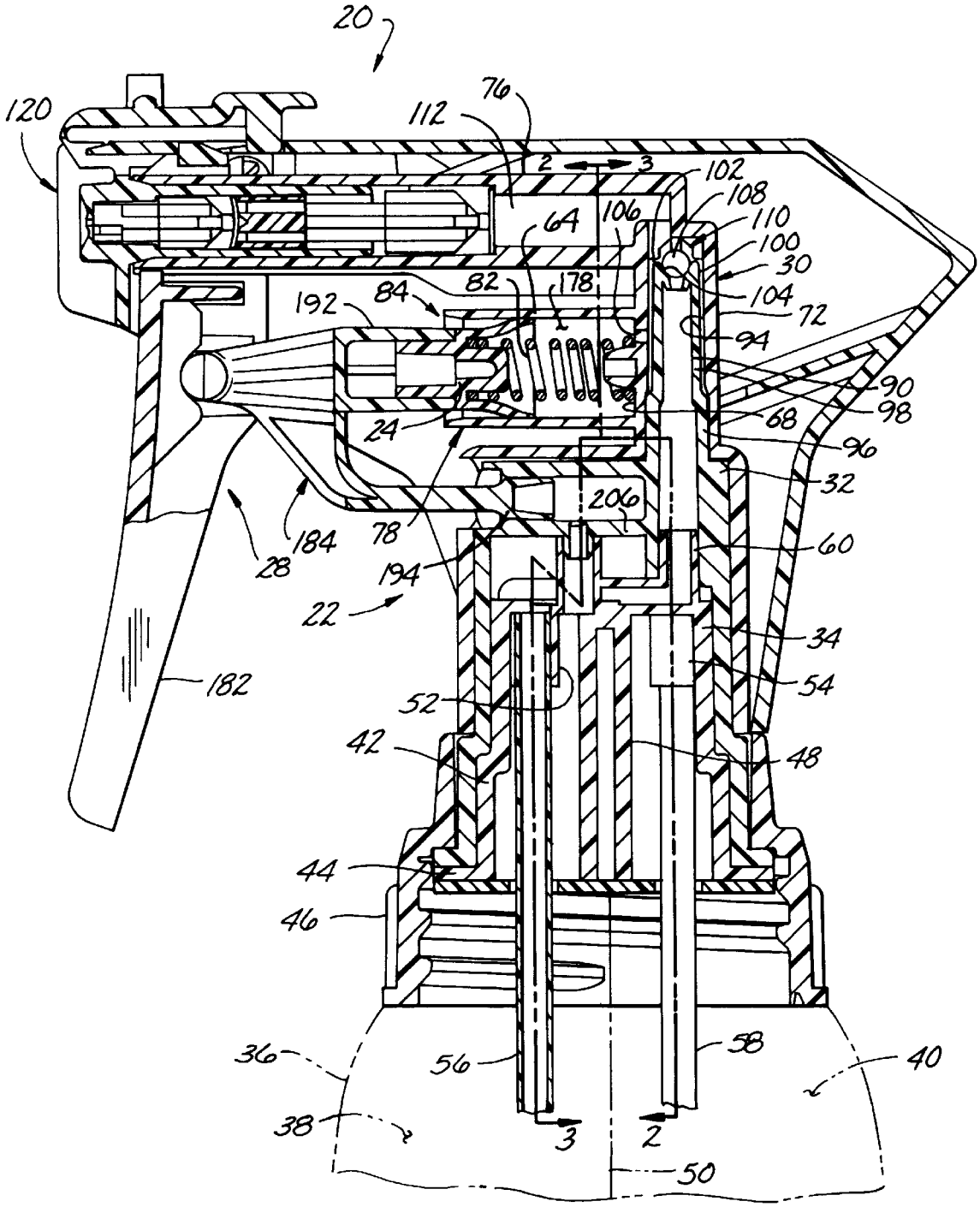
FIG. 1 is a side elevational view, in section, of a fluid dispenser of the present invention.

Referring now to the drawings, and first more particularly to FIG. 1, a trigger dispenser (or sprayer) of the present invention is indicated in its entirety by the reference numeral 20. The trigger sprayer is similar to the trigger sprayer disclosed in commonly assigned U.S. application Ser. No. 08/349,741, filed Dec. 5, 1994 and incorporated herein by reference. Preferably, the trigger sprayer 20 includes a dispenser body, generally indicated at 22, first and second pump pistons 24, 26, and a trigger assembly 28. The dispenser body 22 includes a pump chamber section 30, a vent chamber section 32, and a dip tube adapter 34. The dip tube adapter 34 is press fit into the bottom of the vent chamber section 32, which is press fit into the bottom of the pump chamber section 30.

The dip tube adapter 34 is configured to cover the top of a liquid container 36 having first and second separate fluid compartments 38, 40 configured for holding first and second fluids. The dip tube adapter 34 has an upstanding body 42 and an annular flange 38 circumscribing the lower end of the upstanding body. The flange 38 is positioned over the top of the container 36 when the trigger sprayer 20 is connected to the container. A threaded closure cap 46 surrounds the flange 38 and is threaded to the container 36 to secure the dispenser body 22 to the container. Preferably, a suitable gasket is positioned at the underside of the flange 38 to seal against leakage between the flange and the container 36. The dip tube adapter 34 includes a generally vertical partition 48 dividing the interior of the dip tube adapter. The partition 48 extends to the bottom surface of the adapter flange 44 and sealingly engages a partition 50 of the container 36 to prevent leakage therebetween.

A pair of dip tube receiving sockets 52, 54 extend downwardly from a top wall of the dip tube adapter 34 for receiving the upper ends of dip tubes 56, 58 configured for extending down into the first and second fluid compartments 38, 40 of the liquid container 36. A pair of tube portions 60, 62 extend upwardly from the top wall of the dip tube adapter 34 and are in fluid communication with the dip tube receiving sockets 52, 54 so that liquid flowing up through the dip tubes 56, 58 flows through the tube portions.

The pump chamber section 30 is preferably a single unitary piece and includes first and second cylindric walls 64, 66, first and second circular back walls 68, 70 substantially closing rear ends of the cylindric walls, a vertical formation 72 adjacent the circular back walls, and a horizontal tubular portion 76 extending forward from the upper end of the vertical formation. The inner surface of the first cylindric wall 64 and the first circular back wall 68 define a first pump chamber, generally indicated at 78, open at its forward end for slidably receiving the first piston 24. The inner surface of the second cylindric wall 66 and the second circular back wall 70 define a second pump chamber, generally indicated at 80, open at its forward end for slidably receiving the second piston 26. The first pump chamber 78, first piston 24, and a first return spring 82 constitute components of a first pump mechanism, generally indicated at 84. The second pump chamber 80, second piston 26, and a second spring 86 constitute components of a second pump mechanism, generally indicated at 88.

The vent chamber section 32 is a molded, monolithic (i.e., single piece) member and includes a first tubular portion 90 and a second tubular portion (not shown) substantially identical to the first tubular portion. The first and second tubular portions extend upwardly into first and second vertical bores of the vertical formation 72. The first vertical bore is indicated at 94 in FIG. 1, but the second vertical bore is not shown. However, it is to be understood that the second vertical bore functions in the same way as the first vertical bore. Preferably, each of the tubular portions has a lower region 96, intermediate region 98, and an upper region 100. The lower regions 96 are sized for a snug fit in the vertical bores of the vertical formation 72 to provide a fluid tight seal therebetween. The intermediate regions 98 have outer diameters which are less than the inner diameters of the vertical bores. The outer surfaces of the intermediate regions 98 and the inner surfaces of the vertical bores define annular fluid passages 102 (only one of which is shown in FIG. 1) therebetween. Preferably, the inside diameters of the lower regions 96 of the tubular portions are sized for a snug fit of the tube portions 60 of the dip tube adapter 34.

The upper regions 100 of the tubular portions include first and second check-valve seats 104 (only one of which is shown in FIG. 1). The check-valve seats 104 define first and second intake ports (also referred to by reference numbers 104) of the trigger sprayer 20. The first and second intake ports 104 are in fluid communication with the corresponding first and second fluid compartments 38, 40 of the liquid container 36 via the dip tubes 56, 58 and the dip tube adapter 34.

The pump chamber section 30 of the dispenser body 22 further includes lateral openings 106 extending through the circular back walls 68, 70. Preferably, the lateral openings 106 are respectively aligned with the intermediate regions 98 of the first and second tubular portions for providing fluid communication between the first and second pump chambers 78, 80 and the annular fluid passages 102. The upper regions 100 of the tubular portions, the annular fluid passages 102, and the lateral openings 106 define first and second intake liquid flow paths providing fluid communication between the intake ports 104 and the first and second pump mechanisms 84, 88.

Each of the check-valve seats 104 is shaped and configured for receiving a ball 108. The check-valve seats 104 and corresponding balls 108 constitute check valves, generally indicated at 110, in the intake liquid flow paths for permitting fluid flow from the first and second dip tubes 56, 58 to the first and second pump mechanisms 84, 88, respectively, and for checking fluid flow from the pump mechanisms to the dip tubes. The balls 108 constitute moveable valve members of the check valves 110.

Figure 2:
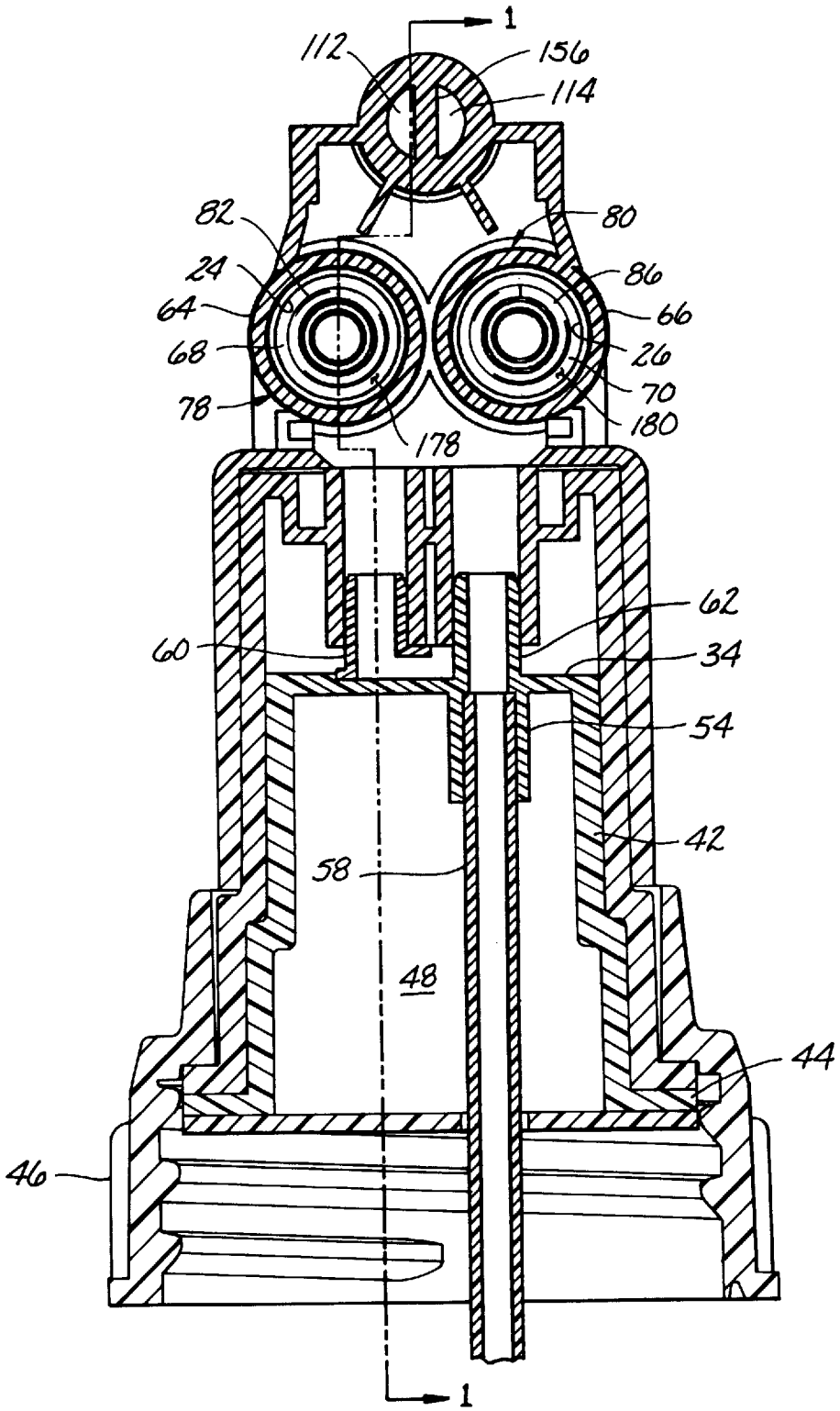
FIG. 2 is a cross-sectional view taken along the plane of line 2—2 of FIG. 1.
Figure 3:
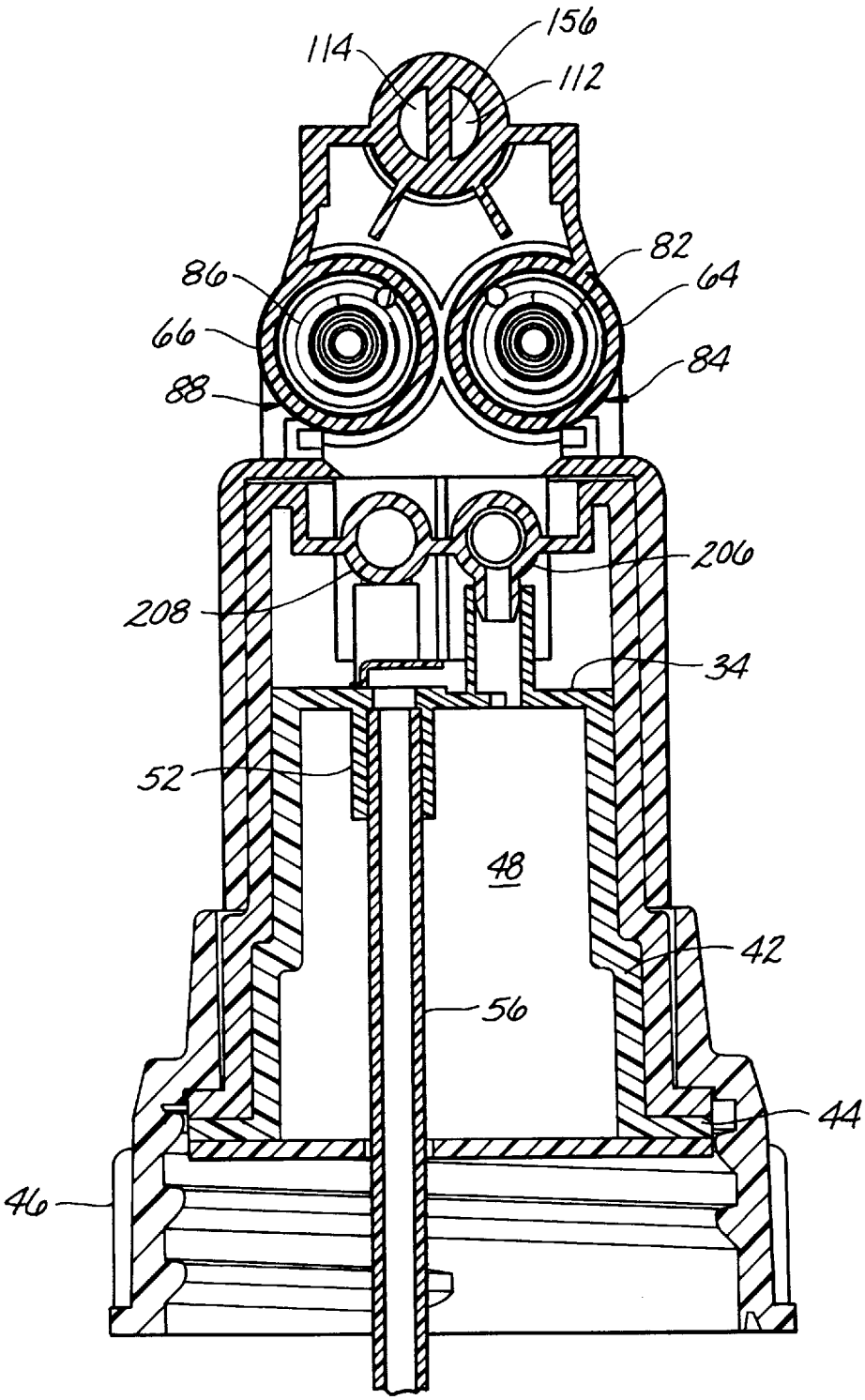
FIG. 3 is a cross-sectional view taken along the plane of line 3—3 of FIG. 1.

The horizontal tubular portion 76 of the pump chamber section 30 includes first and second discharge liquid passageways 112, 114 (FIGS. 2 and 3) in fluid communication with the upper ends of the vertical bores of the vertical formation 72, and a horizontal bore 116 defining a third discharge liquid passageway 118 downstream of the first and second discharge liquid passageways. The first discharge passageway 112, is shaped and configured for passage of liquid from the first pump chamber 78 to the third discharge liquid passageway 118. The second discharge passageway 114, is shaped and configured for passage of liquid from the second pump chamber 80 to the third discharge liquid passageway 118. The horizontal bore 116 extends forward from the first and second discharge passageways 112, 114 to a forward end (left end as viewed in FIG. 1) of the dispenser body 22.

A nozzle assembly 120 is connected to the dispenser body 22 at the forward end of the horizontal bore 116. The nozzle assembly 120 includes a tubular projection 122 inserted into the horizontal bore 116 via the forward (downstream) end of the bore, a nozzle wall 124 at a forward end of the nozzle tubular projection, and a nozzle orifice 126 through the nozzle wall and in fluid communication with the interior of the bore. The tubular projection 122 in part defines the third discharge liquid passageway 118. As will be discussed in greater detail below, first and second separate liquids flows from the first and second pump chambers 78, 80, through the first and second discharge liquid passageways 112, 114, into the third discharge liquid passageway 118 (which constitutes a common location) where they are mixed, and then out through the nozzle orifice 126.

Referring now to FIGS. 4–7, the third discharge liquid passageway 118 includes a mixing chamber 128 and a spinner chamber 130 downstream of the mixing chamber. Within the mixing chamber 128 is an upstream valve assembly 132. The upstream valve assembly 132 is preferably of a monolithic construction and includes a longitudinal stem 134, a disk-shaped member 136 at a rearward end of the longitudinal stem, a tab protruding rearwardly (i.e., to the right as viewed in FIGS. 4 and 5) from the disk-shaped member, and a plurality of centering fins 140 extending radially from the longitudinal stem for centering the stem and disk-shaped member 136 in the third discharge liquid passageway 118. The horizontal tubular portion 76 includes an annular shoulder 142 circumscribing the forward ends of the first and second discharge liquid passageways 112, 114. The disk-shaped member 136 is sized and configured for sealingly engaging the annular shoulder 142 to cover forward ends of the first and second discharge liquid passageways 112, 114. The disk-shaped member 136 and the annular shoulder 142 combine to comprise first and second upstream check valves 144, 146. The portion of the disk-shaped member 136 covering the first discharge liquid passageway 112 constitutes a moveable valve member 148 of the first upstream check valve 144, and the semi-circular portion of the annular shoulder 142 adjacent the first discharge liquid passageway constitutes a valve seat 150 of the first upstream check valve. The portion of the disk-shaped member 136 covering the second discharge liquid passageway 114 constitutes a moveable valve member 152 of the second upstream check valve 146, and the semi-circular portion of the annular shoulder 142 adjacent the second discharge liquid passageway constitutes a valve seat 154 of the second upstream check valve. The moveable valve member 148 of the first upstream valve 144 is moveable between a seated position and an unseated position. In the seated position, the moveable valve member 148 of the first upstream valve 144 seals against the valve seat 150 for checking fluid flow from the mixing chamber 128 to the first discharge liquid passageway 112. In the unseated position, at least a portion of the moveable valve member 148 of the first upstream valve 144 flexes forward and away from the valve seat 150 to permit fluid flow from the first discharge liquid passageway 112 to the mixing chamber 128. The moveable valve member 152 of the second upstream check valve 146 is moveable between a seated position and an unseated position. In the seated position, the moveable valve member 152 of the second upstream valve 146 seals against the valve seat 154 for checking fluid flow from the mixing chamber 128 to the second discharge liquid passageway 114. In the unseated position, at least a portion of the moveable valve member 152 of the second upstream valve 146 flexes forward and away from the valve seat 154 to permit fluid flow from the second discharge liquid passageway 114 to the mixing chamber 128.

Figure 4:
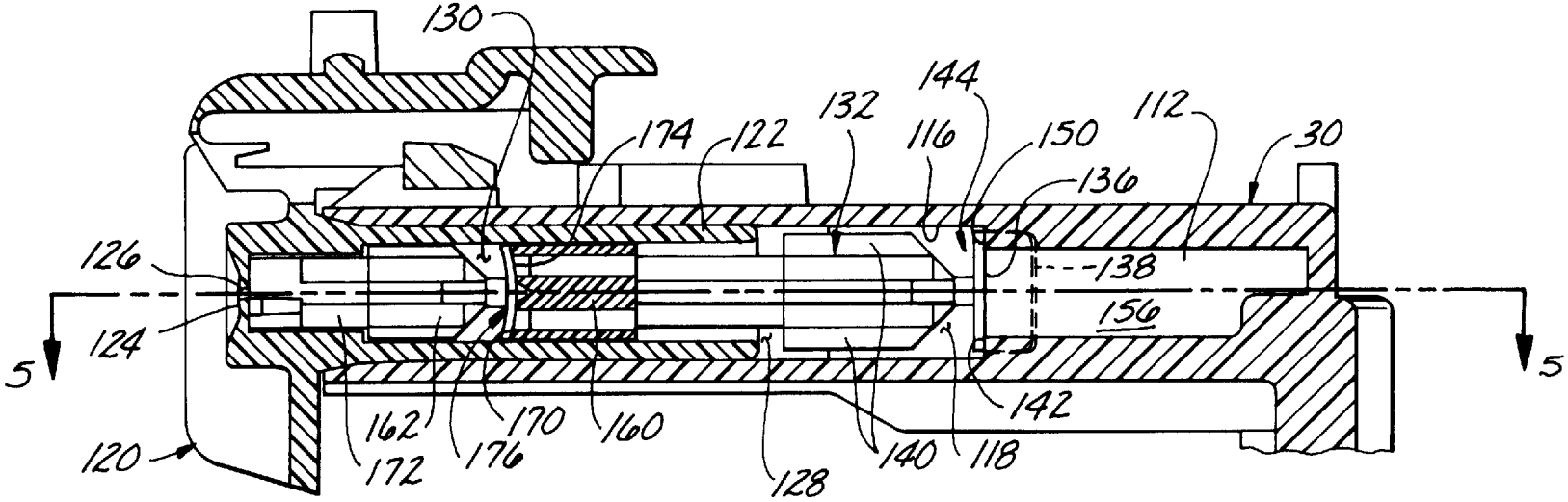
FIG. 4 is an enlarged, fragmented, side elevational view, in section, of a discharge pathway of the fluid dispenser of FIG. 1 showing upstream and downstream check-valves and a spinner assembly.
Figure 5:
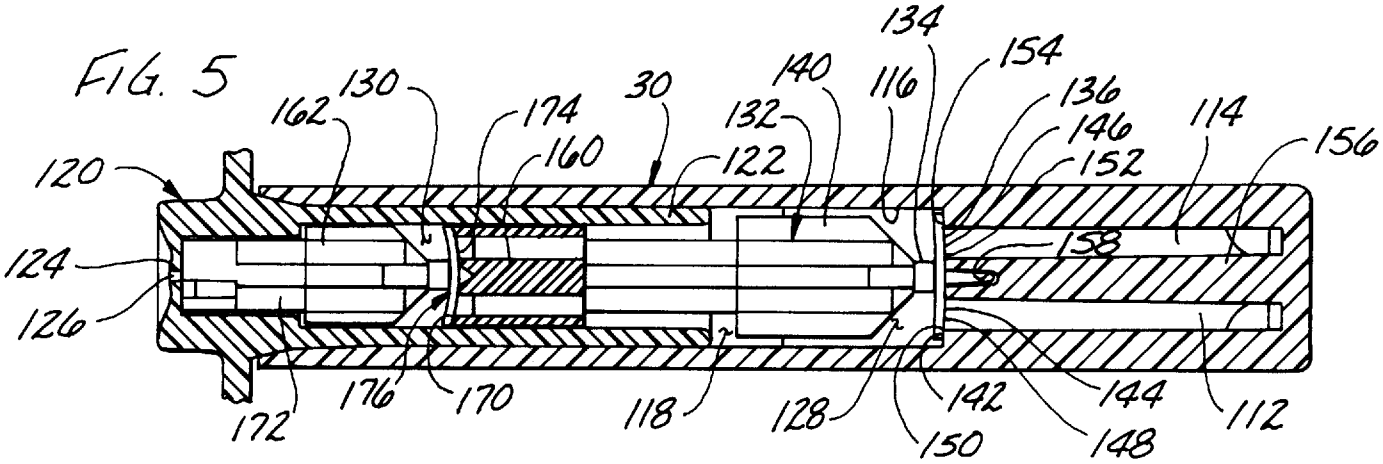
FIG. 5 is a cross-sectional view taken along the plane of line 5—5 of FIG. 4.
Figure 6:
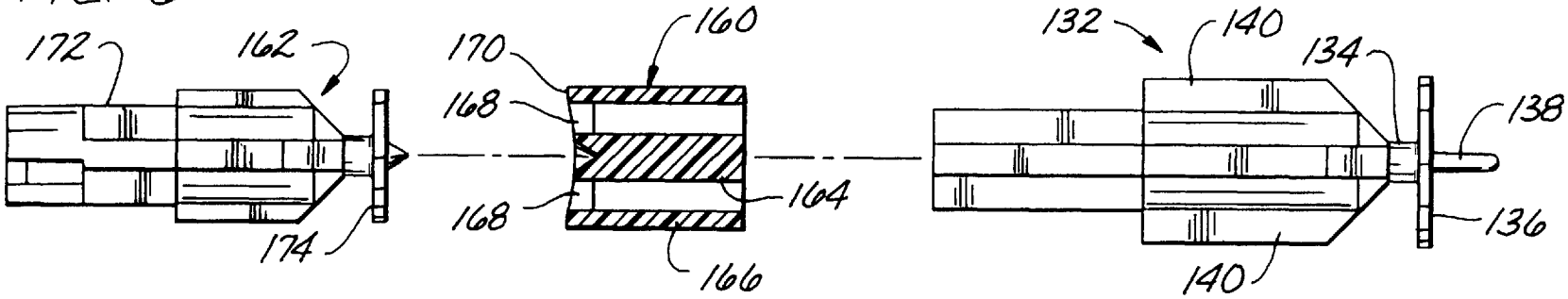
FIG. 6 is an exploded top plan view of the valves and spinner assembly of the trigger sprayer of FIGS. 4 and 5.
Figure 7:
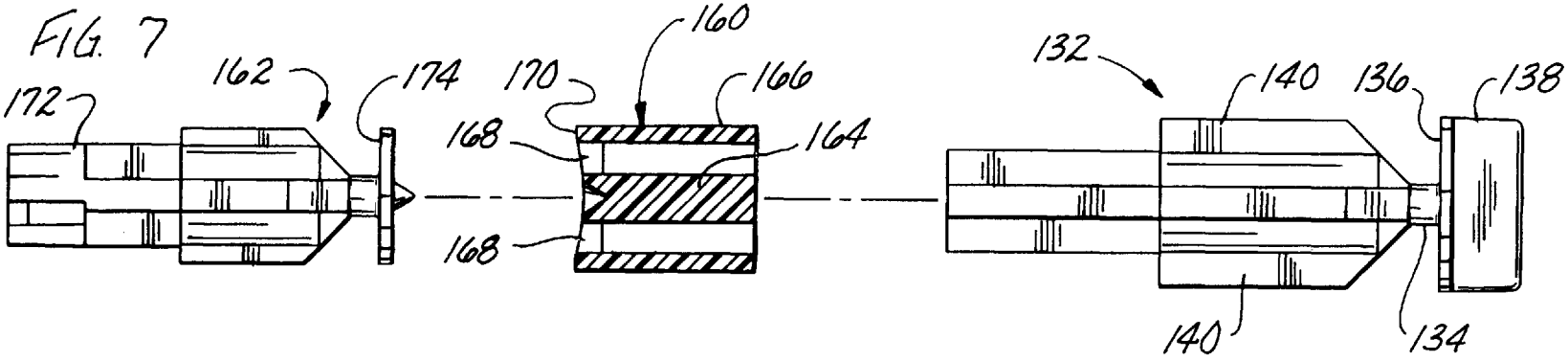
FIG. 7 is an exploded side elevational view of the valves and spinner assembly of FIG. 6.
Figure 10:
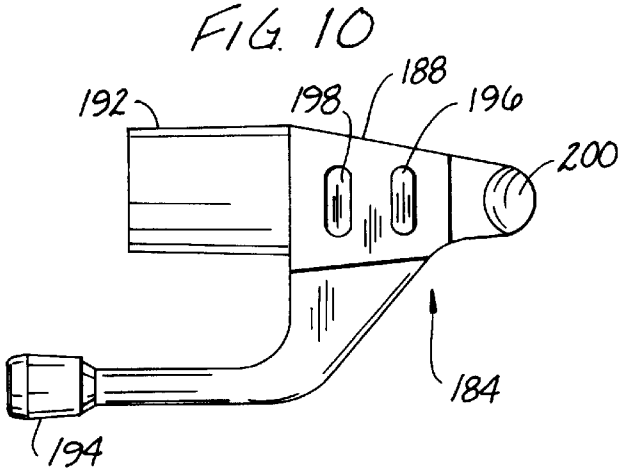
FIG. 10 is a right side elevational view of the pusher member of FIG. 8.
Figure 9:
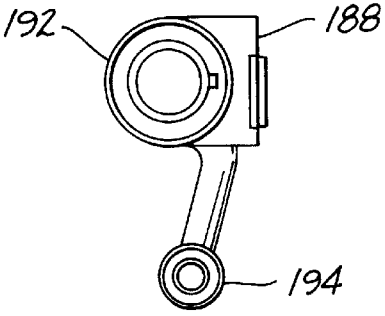
FIG. 9 is a rear end elevational view of the pusher member of FIG. 8.
Figure 8:
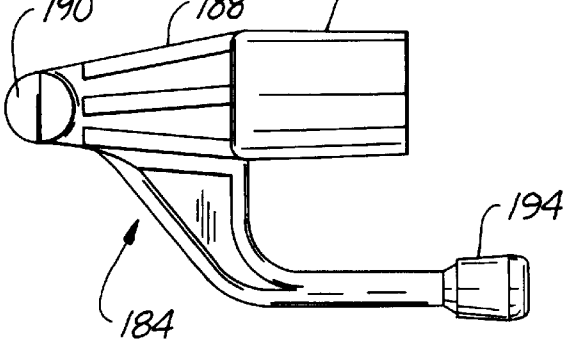
FIG. 8 is a left side elevational view of a pusher member of the trigger sprayer of FIG. 1.
Figure 11:
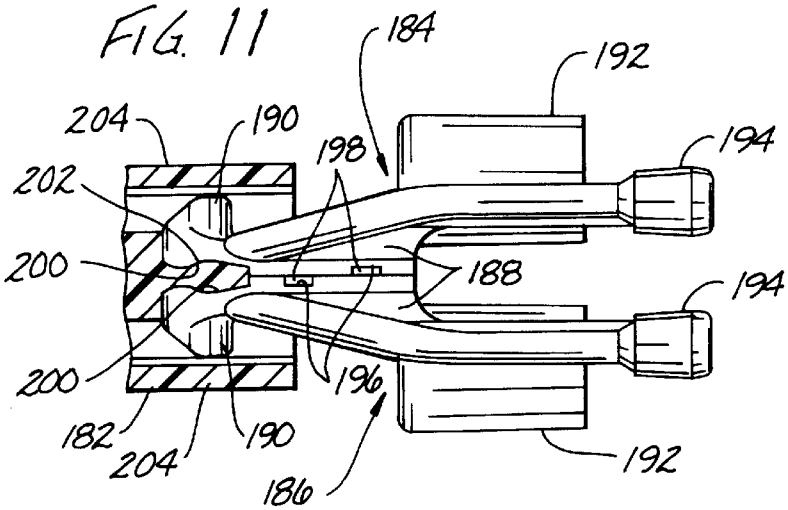
FIG. 11 is a fragmented bottom plan view of the two pusher members of the trigger sprayer of FIG. 1 attached to a trigger of the sprayer with parts of the trigger being broken away to show detail.

A partition 156 separates the first and second passageways 112, 114. The rearwardly protruding tab 138 of the upstream valve assembly 132 extends into a slot 158 formed in the partition 156. As shown in FIG. 4, the tab 138 is preferably wider than the discharge ends of the first and second discharge passageways 112, 114 to prevent fluid leakage between the disk-shaped member and the partition 156.

The trigger sprayer 20 further includes a spacer member 160 and a spinner assembly 162 within the third discharge liquid passageway 118. The spacer member 160 is within the mixing chamber 128 and forward of the upstream valve assembly 132. The spinner assembly 162 is within the spinner chamber 130 and forward of the spacer member 160. The nozzle assembly 120 tightly holds the spinner assembly 162, spacer member 160, and upstream valve assembly 132 in the third discharge liquid passageway 118 and thereby limits their axial movement.

The spacer member 160 is of a monolithic construction and has a central stem 164, a tubular outer wall 166, and a plurality of fins 168 extending radially from the central stem to the outer wall. The forward end of the tubular outer wall 166 comprises an annular shoulder 170.

The spinner assembly 162 includes a spinner portion 172 at its forward end and a resilient disc 174 at its rearward end (right end as viewed in FIG. 1). The spinner portion 172 is shaped and configured to impart a swirl to liquid flowing forward through the third discharge liquid passageway 118 to dispense the liquid from the nozzle orifice 126 in a spray pattern. The resilient disc 174 is engageable with the annular shoulder 170 of the spacer member 160. The resilient disc 174 and the annular shoulder 170 constitute a downstream check valve 176 for permitting fluid flow from the mixing chamber 128 to the spinner chamber 130 and for checking fluid flow from the spinner chamber to the mixing chamber. In particular, the resilient disc 174 of the spinner assembly 162 constitutes a moveable valve member of the downstream check valve 176, and the annular shoulder 170 of the spacer member 160 constitutes a valve seat of the downstream check valve. The resilient disc 174 is moveable between a closed position and an open position. In its closed (or seated) position, the resilient disc 174 sealing engages the annular shoulder 170 all around the shoulder to prevent passage of liquid therethrough. In its open (unseated) position, at least a part of the resilient disc 174 flexes forwardly away from the annular shoulder 170 to thereby provide a gap between the resilient disc and the shoulder to allow liquid to flow therethrough.

Referring again to FIG. 1, the first and second pistons 24, 26 are preferably formed of a suitable resilient material such as low density polyethylene. The first and second pistons 24, 26 are respectively slidable within the first and second pump chambers 78, 80 and configured for sealing engagement with the cylindric inner surfaces of the pump chambers all around the pistons to seal against leakage of fluid between the pump chambers and their respective pistons. The first piston 24 and the first pump chamber 78 define a first variable volume fluid receiving cavity 178. The second piston 26 and the second pump chamber 80 define a second variable volume fluid receiving cavity 180. The pistons 24, 26 are reciprocally slidable in their respective pump chambers 78, 80 between forward (extended) position and a rearward (compressed) position. As discussed below, the pistons 24, 26 are simultaneously moved from their extended positions to their compressed positions by rearward movement of the trigger assembly 28. The return springs 82, 86 are configured for urging the pistons 24, 26 forward to their extended positions. Thus, the pistons 24, 26 are rearwardly moved from their extended positions to their compressed positions by manually squeezing the trigger assembly 28, and are automatically returned to their extended positions via the return spring 82, 86 when the operator releases the trigger assembly.

Referring now to FIGS. 1 and 8–11, the trigger assembly 28 comprises a trigger 182 and first and second separate pusher members 184, 186. The trigger 182 is pivotally connected to the dispenser body 22 for movement between first (forward) and second (rearward) positions and configured for engaging the first and second pusher members 184, 186. The trigger 182 and pusher members 184, 186 are configured so that movement of the trigger from its forward position to its rearward position effectuates simultaneous movement of the pump pistons 24, 26 from their extended positions to their retracted positions, and movement of the trigger from its rearward position to its forward position effectuates simultaneous movement of the pump pistons from their retracted positions to their extended positions.

Each of the pusher members 184, 186 is of a molded monolithic construction and includes a body portion 188, a trunnion 190 extending laterally from a forward portion of the body portion and engageable with the trigger 182, a socket portion 192 extending rearwardly from the body portion and sized for snugly receiving a forward end of one of the pistons, and a vent plug 194 extending rearwardly from the body portion. The body portion 188 includes one slot 196 and one tab 198. The tab 198 of each pusher member is configured for extending into and thereby intermesh with the slot 196 of the other pusher member to prevent axial movement (i.e., right to left or left to right movement as viewed in FIGS. 1 and 11) of one pusher member relative to the other. Each pusher member further includes a recess 200 engageable with a pivot web (or trigger protrusion) 202 of the trigger 182. When the pusher members 184, 186 are connected together and in engagement with the trigger 182, then the pivot web 202 of the trigger is sandwiched between the recesses 200 of the pusher members. The recesses 200 and pivot web 202 are shaped and configured to provide an interference fit between the trigger 182 and pusher members 184, 186 to thereby lock the pivot web between the recesses of the pusher members so that movement of the trigger causes movement of the pusher members. Also, the trunnions 190 are closely adjacent opposing side walls 204 of the trigger 182 to prevent lateral movement of one pusher member relative to the other. Thus, the first and second pusher members 184, 186 are configured to engage one another in a manner to limit relative movement therebetween as the trigger 182 is moved between its forward and rearward positions.

Referring again to FIGS. 1–3, the vent chamber section 32 further includes first and second horizontal vent cylinders 206, 208 for receiving the vent plugs 194 of the first and second pusher members 184, 186. The interior regions of the vent cylinders 206, 208 are in fluid communication with the insides of the first and second fluid compartments 38, 40, respectively, via suitable vent passages. When the trigger 182 is in its forward position, then the vent plugs 194 block the forward ends of the vent cylinders 206, 208 to prevent liquid in the compartments 38, 40 from leaking from the vent cylinders. When the trigger 182 is in its rearward position, then the vent plugs 194 are positioned in rearward regions of the vent cylinders 206, 208 to thereby open the compartments 38, 40 to atmosphere via the vent cylinders.

In operation, the operator squeezes the trigger 182 to simultaneously move the pusher members 184, 186 rearwardly to simultaneously move the pistons 24, 26 to their compressed positions (not shown), and then releases the trigger to allow the return springs 82, 86 to move the pistons 24, 26, pusher members 184, 186, and trigger 182 to their forward positions. This forward movement of the pistons 24, 26 creates a vacuum pressure in the fluid receiving cavities 178, 180 which unseats the balls 108 of the valves 110 up away from the valve seats 104 and draws liquid from the first and second fluid compartments 38, 40 into the fluid receiving cavities. Rearward movement of the pistons 24, 26 pressurizes the liquids in the fluid receiving cavities 178, 180. This pressure unseats the moveable valve members 148, 152 of the first and second upstream valves 144, 146 to allow the liquids to flow into the mixing chamber 128 where they are mixed. The pressurized mixed liquids then unseat the disc 174 of the downstream check valve 176 to permit the mixed liquids to flow into the spinner chamber 130 where they are swirled and then discharged through the nozzle orifice 126 as a spray. Because the downstream check valve 176 is downstream of the region where the liquids are mixed, it helps ensure that the liquids are mixed prior to entering the spinner chamber 130. Because the downstream check valve 176 is in its closed position when liquid is not being dispensed, it prevents the mixing chamber 128 from being open to atmosphere. Thus, the downstream check valve 176 assists the upstream check valves 144, 146 in preventing liquid in the mixing chamber from flowing back into the first and second discharge liquid passageways 112, 114.

Although the first and second pump mechanisms 84, 88 have been described as having internal coil return springs 82, 86, it is to be understood that other return springs, such as external leaf springs, could be employed without departing from the scope of this invention. Also, the nozzle assembly could include a rotatable nozzle cap for varying the spray pattern or closing the nozzle orifice.

Figure 12:
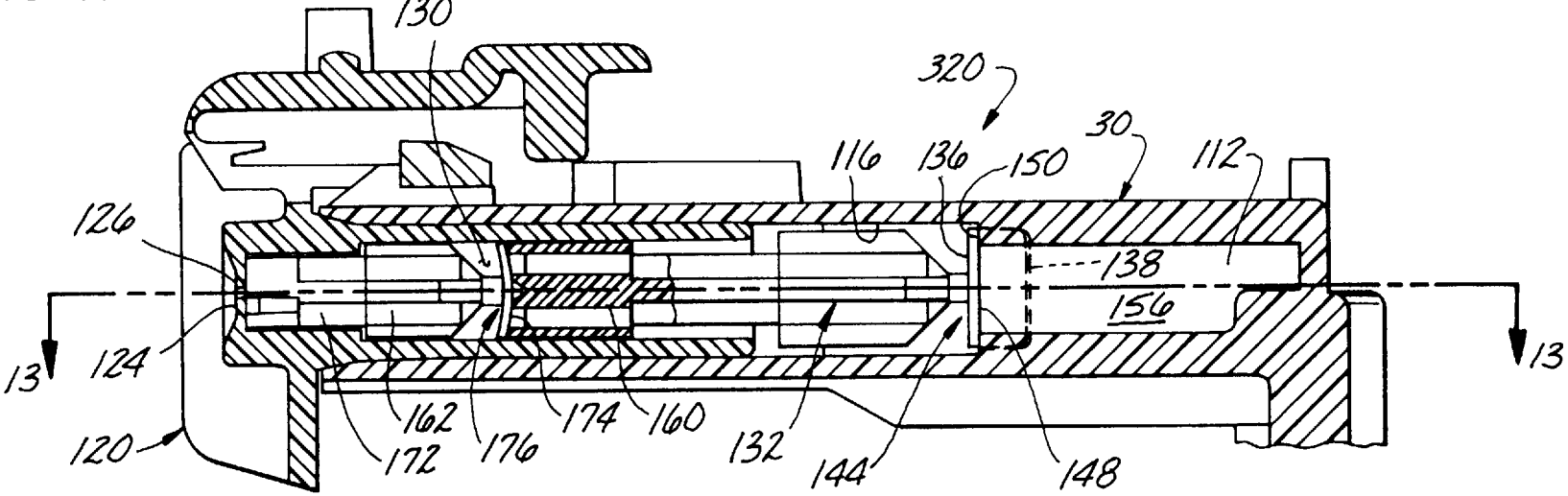
FIG. 12 is an enlarged, fragmented, side elevational view, in section of a discharge pathway of another fluid dispenser of the present invention showing upstream and downstream check-valves and a spinner assembly.
Figure 13:
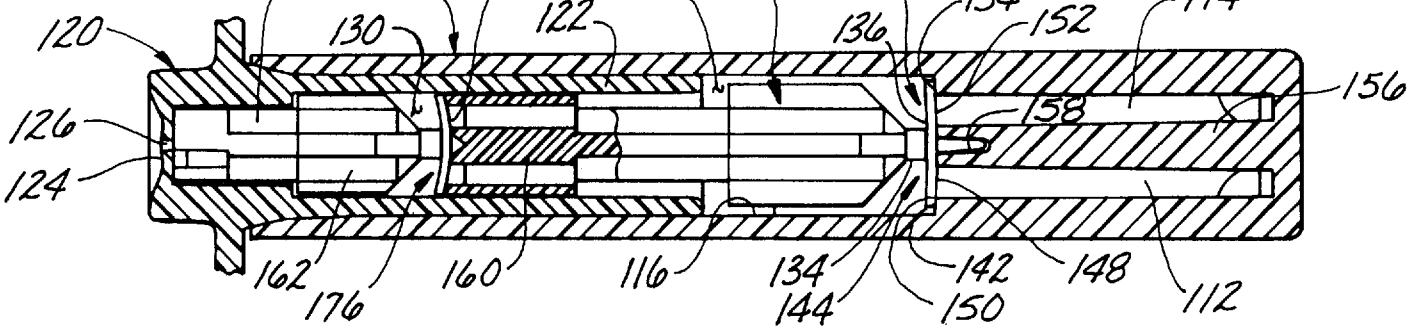
FIG. 13 is a cross-sectional view taken along the plane of line 13—13 of FIG. 12.

Referring now to FIGS. 12 and 13, the nozzle assembly and discharge region of another trigger sprayer of the present invention is shown. This trigger sprayer is generally indicated at 320. The trigger sprayer 320 is identical to the trigger sprayer 20 of FIGS. 1–11 except the spacer member 160 is integral with the upstream valve assembly 132. In other words, the spacer member 160 and upstream valve assembly 132 are of a monolithic construction. Thus, the valve seat 170 of the downstream check valve 176 and the moveable valve members 148, 152 of the first and second upstream check valves 144, 146 are of a single unitary piece. Because the trigger sprayer 20 is identical to the trigger sprayer 320 in all other respects, the detailed description of the trigger sprayer 20 is equally applicable to the trigger sprayer 320, and therefore further description of the trigger sprayer 320 is unnecessary.

Figure 14:
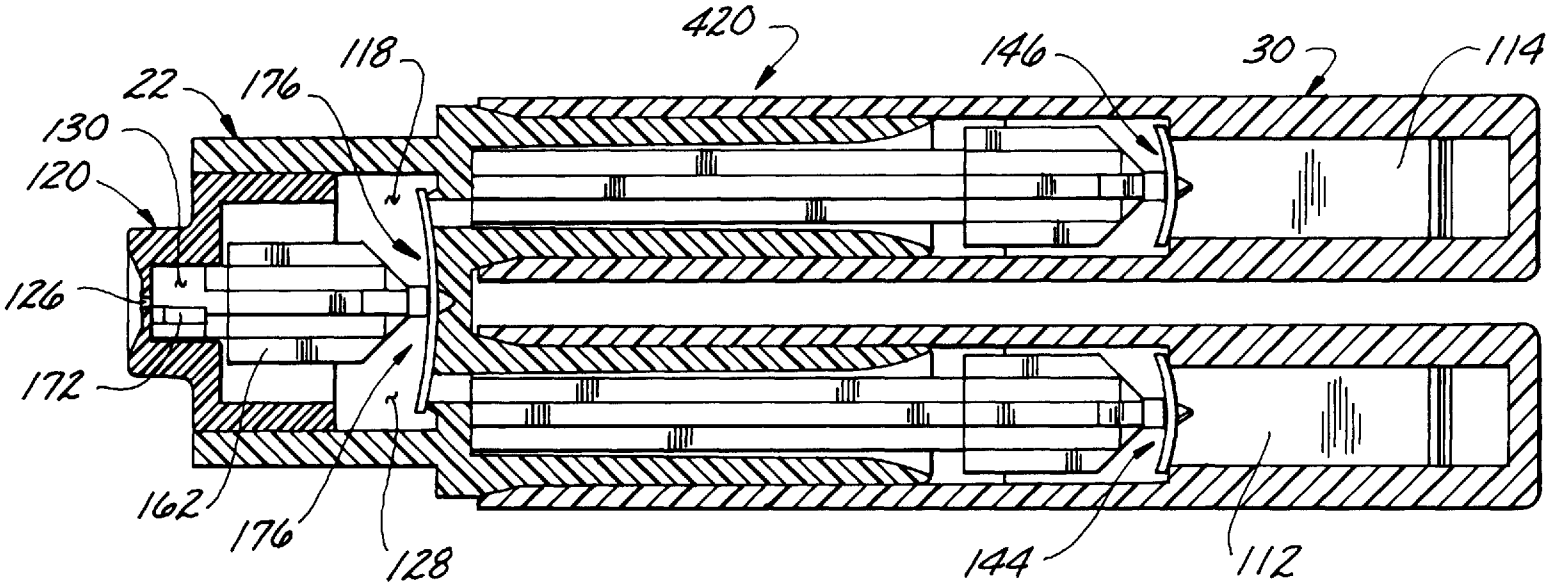
FIG. 14 is an enlarged cross-sectional view of another fluid dispenser of the present invention showing upstream and downstream check-valves and a spinner assembly.

Referring now to FIG. 14, the nozzle assembly and discharge region of another trigger sprayer of the present invention is shown. This trigger sprayer is generally indicated at 420. The trigger sprayer 420 is similar to the trigger sprayer 20 except for the upstream and downstream check valves. In this embodiment, the first upstream check valve 144 is contained in the first discharge liquid passageway 112, and the second upstream check valve 146 is contained in the second discharge liquid passageway 114. The mixing chamber 128 is downstream of the downstream check valve 176. This downstream check valve 176 is effectively two valves, one checking fluid flow from the mixing chamber 128 to the first discharge liquid passageway 112, and the other checking fluid flow from the mixing chamber to the second discharge liquid passageway 114. Because of the upstream and downstream valves, it is unlikely mixed liquids will flow back into the pump chambers.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A trigger dispenser for drawing at least two separate liquids from first and second separate liquid sources and simultaneously dispensing the liquids from the dispenser, the dispenser comprising:

a dispenser body having first and second pump chambers, a first intake port adapted for fluid communication with the first liquid source, a second intake port adapted for fluid communication with the second liquid source, a first intake liquid flow path for passage of fluid from the first intake port to the first pump chamber, a second intake liquid flow path for passage of fluid from the second intake port to the second pump chamber, and first and second discharge liquid passageways for passage of liquid from the first and second pump chambers to a common location;

first and second pump pistons respectively moveable in the first and second pump chambers, the pump pistons and pump chambers defining first and second variable volume fluid receiving cavities, the pump pistons being reciprocally moveable in their respective pump chambers between extended positions in which the fluid receiving cavities have extended volumes and retracted positions in which the fluid receiving cavities have retracted volumes smaller than the extended volumes, the pump pistons and dispenser body being configured so that movement of the pump pistons from their retracted positions to their extended positions draws liquid from the intake liquid flow paths and movement of the pump pistons from their extended positions to their retracted positions discharges the drawn liquids from the pump chambers to said common location;

first and second pusher members respectively connected to the first and second pump pistons;

a trigger pivotally connected to the dispenser body for movement between first and second positions, and configured for engaging the first and second pusher members;

the trigger and pusher members being configured so that movement of the trigger from its first position to its second position effectuates simultaneous movement of the pump pistons from their extended positions to their retracted positions;

the first and second pusher members being shaped and configured so that a portion of the first pusher member intermeshes with a portion of the second pusher member in a manner to limit relative movement therebetween as the trigger is moved between its first and second positions.

2. A trigger dispenser as set forth in claim 1 wherein each of the first and second pusher members includes a trigger engaging portion configured for engaging a part of the trigger, said part of the trigger being sandwiched between the trigger engaging portions of the first and second pusher members when the pusher members engage the trigger.

3. A trigger dispenser as set forth in claim 1 wherein the first and second pump chambers are in a side-by-side orientation.

4. A trigger dispenser as set forth in claim 1 wherein said common location comprises a third discharge liquid passageway, the first and second discharge passageways being shaped and configured for passage of liquid from the first and second pump chambers to the third discharge liquid passageway, said third discharge liquid passageway being defined at least in part by the dispenser body.

5. A trigger dispenser as set forth in claim 4 further comprising:

a nozzle connected to the dispenser body, the nozzle including a nozzle orifice in fluid communication with the third discharge liquid passageway;

a fluid spinner member in the third discharge liquid passageway;

the pump pistons, dispenser body, and nozzle being configured so that movement of the pump pistons from their extended positions to their retracted positions discharges the drawn liquids from the pump chambers to the third discharge liquid passageway where the liquids are mixed, and discharges the mixed liquids through the nozzle orifice.

6. A trigger dispenser as set forth in claim 5 wherein the third discharge liquid passageway includes a mixing chamber where the liquids are mixed, and a spinner chamber downstream of the mixing chamber and holding the fluid spinner member.

7. A trigger dispenser as set forth in claim 6 further comprising a check valve in the third discharge liquid passageway configured for permitting fluid flow from the mixing chamber to the spinner chamber and for checking fluid flow from the spinner chamber to the mixing chamber.

8. A trigger dispenser as set forth in claim 7 wherein said check valve constitutes a downstream check valve, the trigger dispenser further comprising first and second upstream check valves, the first upstream check valve being configured for permitting fluid flow from the first discharge passageway to the mixing chamber and for checking fluid flow from the mixing chamber to the first discharge passageway, the second upstream check valve being configured for permitting fluid flow from the second discharge passageway to the mixing chamber and for checking fluid flow from the mixing chamber to the second discharge passageway.

9. A dispenser for drawing at least two separate liquids from first and second separate liquid sources and simultaneously dispensing the liquids from the dispenser, the dispenser comprising:

a dispenser body having first and second pump chambers, a first intake port adapted for fluid communication with the first liquid source, a second intake port adapted for fluid communication with the second liquid source, a first intake liquid flow path for passage of fluid from the first intake port to the first pump chamber, a second intake liquid flow path for passage of fluid from the second intake port to the second pump chamber, and first and second discharge liquid passageways;

a third discharge liquid passageway defined at least in part by the dispenser body, the third discharge liquid passageway including a mixing chamber and a spinner chamber downstream of the mixing chamber, the first discharge liquid passageway being configured for passage of liquid from the first pump chamber to the mixing chamber, the second discharge liquid passageway being configured for passage of liquid from the second pump chamber to the mixing chamber;

a check valve in the third discharge liquid passageway configured for permitting fluid flow from the mixing chamber to the spinner chamber and for checking fluid flow from the spinner chamber to the mixing chamber;

a nozzle connected to the dispenser body, the nozzle including a nozzle orifice in fluid communication with the spinner chamber;

a fluid spinner member in the spinner chamber;

the pump chambers at least in part defining first and second variable volume fluid receiving cavities, the pump chambers, and intake liquid flow paths being configured so that varying the volume of the fluid receiving cavities draws liquid from the intake liquid flow paths, forces the drawn liquids from the pump chambers to the mixing chambers where the liquids are mixed, and forces the mixed liquids through the spinner chamber and out the nozzle orifice.

10. A dispenser as set forth in claim 9 wherein said check valve constitutes a downstream check valve, the dispenser further comprising first and second upstream check valves, the first upstream check valve being configured for permitting fluid flow from the first discharge passageway to the mixing chamber and for checking fluid flow from the mixing chamber to the first discharge passageway, the second upstream check valve being configured for permitting fluid flow from the second discharge passageway to the mixing chamber and for checking fluid flow from the mixing chamber to the second discharge passageway.

11. A dispenser as set forth in claim 10 wherein each of the downstream and upstream check valves includes a valve seat member and a moveable valve member, the moveable valve member being moveable between a seated position in which the valve member seals against the valve seat member and an unseated position in which at least a portion of the moveable valve member is spaced from the valve seat member, the valve seat member of the downstream check valve and one of the members of each of the upstream check valves being portions of a single unitary piece.

12. A dispenser as set forth in claim 11 wherein the valve seat member of the downstream check valve and the moveable valve members of the upstream check valves are portions of a single unitary piece.

13. A dispenser as set forth in claim 9 further comprising first and second upstream check valves, the first upstream check valve being configured for permitting fluid flow from the first discharge passageway to the mixing chamber and for checking fluid flow from the mixing chamber to the first discharge passageway, the second upstream check valve being configured for permitting fluid flow from the second discharge passageway to the mixing chamber and for checking fluid flow from the mixing chamber to the second discharge passageway.

14. A dispenser as set forth in claim 9 wherein the third discharge liquid passageway is in part defined by the nozzle.

15. A dispenser as set forth in claim 9 further comprising first and second pump pistons respectively moveable in the first and second pump chambers, the pump pistons and pump chambers defining said first and second variable volume fluid receiving cavities, the pump pistons being reciprocally moveable in their respective pump chambers between extended positions in which the fluid receiving cavities have extended volumes and retracted positions in which the fluid receiving cavities have retracted volumes smaller than the extended volumes.

16. A dispenser as set forth in claim 15 further comprising a trigger pivotally connected to the dispenser body for movement between first and second positions, the trigger being operatively connected to the pump pistons in a manner so that movement of the trigger from its first position to its second position effectuates simultaneous movement of the pump pistons from their extended positions to their retracted positions, and movement of the trigger from its second position to its first position effectuates simultaneous movement of the pump pistons from their retracted positions to their extended positions.

17. A dispenser as set forth in claim 16 wherein the trigger is operatively connected to the pump pistons via first and second separate pusher members, the first and second pusher members being configured to engage one another in a manner to limit relative movement therebetween as the trigger is moved between its first and second positions.

18. A trigger dispenser for drawing at least two separate liquids from first and second separate liquid sources and simultaneously dispensing the liquids from the dispenser, the dispenser comprising:

a dispenser body having first and second pump chambers, a first intake port adapted for fluid communication with the first liquid source, a second intake port adapted for fluid communication with the second liquid source, a first intake liquid flow path for passage of fluid from the first intake port to the first pump chamber, a second intake liquid flow path for passage of fluid from the second intake port to the second pump chamber, and first and second discharge liquid passageways for passage of liquid from the first and second pump chambers to a common location;

first and second pump pistons respectively moveable in the first and second pump chambers, the pump pistons and pump chambers defining first and second variable volume fluid receiving cavities, the pump pistons being reciprocally moveable in their respective pump chambers between extended positions in which the fluid receiving cavities have extended volumes and retracted positions in which the fluid receiving cavities have retracted volumes smaller than the extended volumes, the pump pistons and dispenser body being configured so that movement of the pump pistons from their retracted positions to their extended positions draws liquid from the intake liquid flow paths and movement of the pump pistons from their extended positions to their retracted positions discharges the drawn liquids from the pump chambers to said common location;

first and second pusher members respectively connected to the first and second pump pistons;

a trigger pivotally connected to the dispenser body for movement between first and second positions, and configured for engaging the first and second pusher members;

the trigger and pusher members being configured so that movement of the trigger from its first position to its second position effectuates simultaneous movement of the pump pistons from their extended positions to their retracted positions;

each of the first and second pusher members including a trigger engaging portion configured for engaging a part of the trigger, said part of the trigger being sandwiched between the trigger engaging portions of the first and second pusher members when the pusher members engage the trigger.

19. A trigger dispenser as set forth in claim 18 wherein said part of the trigger comprises a trigger protrusion, said trigger protrusion and said trigger engaging portions of the pusher members being shaped and configured to lock the trigger protrusion between the trigger engaging portions of the pusher members when the pusher members engage the trigger.

20. A dispenser for drawing at least two separate liquids from first and second separate liquid sources and simultaneously dispensing the liquids from the dispenser, the dispenser comprising:

a dispenser body having first and second pump chambers, a first intake port adapted for fluid communication with the first liquid source, a second intake port adapted for fluid communication with the second liquid source, a first intake liquid flow path for passage of fluid from the first intake port to the first pump chamber, a second intake liquid flow path for passage of fluid from the second intake port to the second pump chamber, and first and second discharge liquid passageways;

a third discharge liquid passageway defined at least in part by the dispenser body, the third discharge liquid passageway including a mixing chamber and a spinner chamber downstream of the mixing chamber, the first discharge liquid passageway being configured for passage of liquid from the first pump chamber to the mixing chamber, the second discharge liquid passageway being configured for passage of liquid from the second pump chamber to the mixing chamber;

a nozzle connected to the dispenser body, the nozzle including a nozzle orifice in fluid communication with the spinner chamber;

a fluid spinner member in the spinner chamber;

the pump chambers at least in part defining first and second variable volume fluid receiving cavities, the pump chambers, and intake liquid flow paths being configured so that varying the volume of the fluid receiving cavities draws liquid from the intake liquid flow paths, forces the drawn liquids from the pump chambers to the mixing chambers where the liquids are mixed, and forces the mixed liquids through the spinner chamber and out the nozzle orifice;

first and second pump pistons respectively moveable in the first and second pump chambers, the pump pistons and pump chambers defining said first and second variable volume fluid receiving cavities, the pump pistons being reciprocally moveable in their respective pump chambers between extended positions in which the fluid receiving cavities have extended volumes and retracted positions in which the fluid receiving cavities have retracted volumes smaller than the extended volumes;

a trigger pivotally connected to the dispenser body for movement between first and second positions, the trigger being operatively connected to the pump pistons in a manner so that movement of the trigger from its first position to its second position effectuates simultaneous movement of the pump pistons from their extended positions to their retracted positions, and movement of the trigger from its second position to its first position effectuates simultaneous movement of the pump pistons from their retracted positions to their extended positions;

first and second separate pusher members operatively connecting the trigger to the pump pistons, the first and second pusher members being configured to engage one another in a manner to limit relative movement therebetween as the trigger is moved between its first and second positions.

21. A dispenser as set forth in claim 20 wherein the trigger is operatively connected to the pump pistons via first and second separate pusher members, each of the first and second pusher members including a trigger engaging portion configured for engaging a part of the trigger, said part of the trigger being sandwiched between the trigger engaging portions of the first and second pusher members when the pusher members engage the trigger.

22. A dispenser as set forth in claim 21 wherein said part of the trigger comprises a trigger protrusion, said trigger protrusion and said trigger engaging portions of the pusher members being shaped and configured to lock the trigger protrusion between the trigger engaging portions of the pusher members when the pusher members engage the trigger.

23. A dispenser for drawing at least two separate liquids from first and second separate liquid sources and simultaneously dispensing the liquids from the dispenser, the dispenser comprising:

a dispenser body having first and second pump chambers, a first intake port adapted for fluid communication with the first liquid source, a second intake port adapted for fluid communication with the second liquid source, a first intake liquid flow path for passage of fluid from the first intake port to the first pump chamber, a second intake liquid flow path for passage of fluid from the second intake port to the second pump chamber, and first and second discharge liquid passageways;

a third discharge liquid passageway defined at least in part by the dispenser body, the third discharge liquid passageway including a mixing chamber and a spinner chamber downstream of the mixing chamber, the first discharge liquid passageway being configured for passage of liquid from the first pump chamber to the mixing chamber, the second discharge liquid passageway being configured for passage of liquid from the second pump chamber to the mixing chamber;

first and second upstream check valves, the first upstream check valve being configured for permitting fluid flow from the first discharge passageway to the mixing chamber and for checking fluid flow from the mixing chamber to the first discharge passageway, the second upstream check valve being configured for permitting fluid flow from the second discharge passageway to the mixing chamber and for checking fluid flow from the mixing chamber to the second discharge passageway;

a downstream check valve in the third discharge liquid passageway and downstream of the first and second upstream check valves, the downstream check valve being configured for permitting fluid flow from the first and second discharge passageways to the spinner chamber and for checking fluid flow from the spinner chamber to the first and second discharge passageways;

a nozzle connected to the dispenser body, the nozzle including a nozzle orifice in fluid communication with the spinner chamber;

a fluid spinner member in the spinner chamber;

the pump chambers at least in part defining first and second variable volume fluid receiving cavities, the pump chambers, and intake liquid flow paths being configured so that varying the volume of the fluid receiving cavities draws liquid from the intake liquid flow paths, forces the drawn liquids from the pump chambers to the mixing chambers where the liquids are mixed, and forces the mixed liquids through the spinner chamber and out the nozzle orifice.

* * * * *